United States Patent [19]

Kononov et al.

[11] 4,204,458

[45] May 27, 1980

[54] PULSATOR FOR HYDRAULIC SYSTEMS CONTROLLING ACTUATING MECHANISMS

[76] Inventors: Ivan V. Kononov, ulitsa Torpedo, 40, kv. 4; Mikhail P. Makushin, ulitsa Volgo-Donskaya, 16, kv. 41; Ivan E. Maslennikov, ulitsa Lizjukova, 43, kv. 57; Vladimir N. Platonov, ulitsa Lizjukova, 43, kv. 112; Igor I. Silantiev, ulitsa Voroshilova, 44, kv. 98, all of Voronezh, U.S.S.R.

[21] Appl. No.: 954,572

[22] Filed: Oct. 25, 1978

[51] Int. Cl.[2] ..... F15B 21/12

[52] U.S. Cl. ..... 91/429; 91/433; 91/461; 137/596.14

[58] Field of Search ..... 91/429, 433, 461; 137/596.14

[56] References Cited

U.S. PATENT DOCUMENTS 3,851,667 12/1974 Goryainov et al. ..... 137/624.14

*Primary Examiner*—Gerald A. Michalsky

*Attorney, Agent, or Firm*—Steinberg and Blake

[57] ABSTRACT

The pulsator for hydraulic systems controlling actuating mechanisms has a housing accommodating a pusher made in the form of a piston with a rod, a delivery valve, a pneumatic piston displacing in the cavity connected to the pneumatic control system. Above the pusher piston there is an upper cavity communicating with a high-pressure main, and under the piston there is a lower cavity communicating with the actuating mechanism via a non-return valve. A stem is provided between the rod and the piston. Also made above the pusher piston is an auxiliary cavity which is an extension of the upper cavity, defined by a leading edge and connected to the actuating mechanism. Above the lower cavity of the pusher piston there is an annular cavity disposed coaxially with said cavity, separated from said cavity by the leading edge, connected to the valve controlling resetting of the pusher.

1 Claim, 1 Drawing Figure

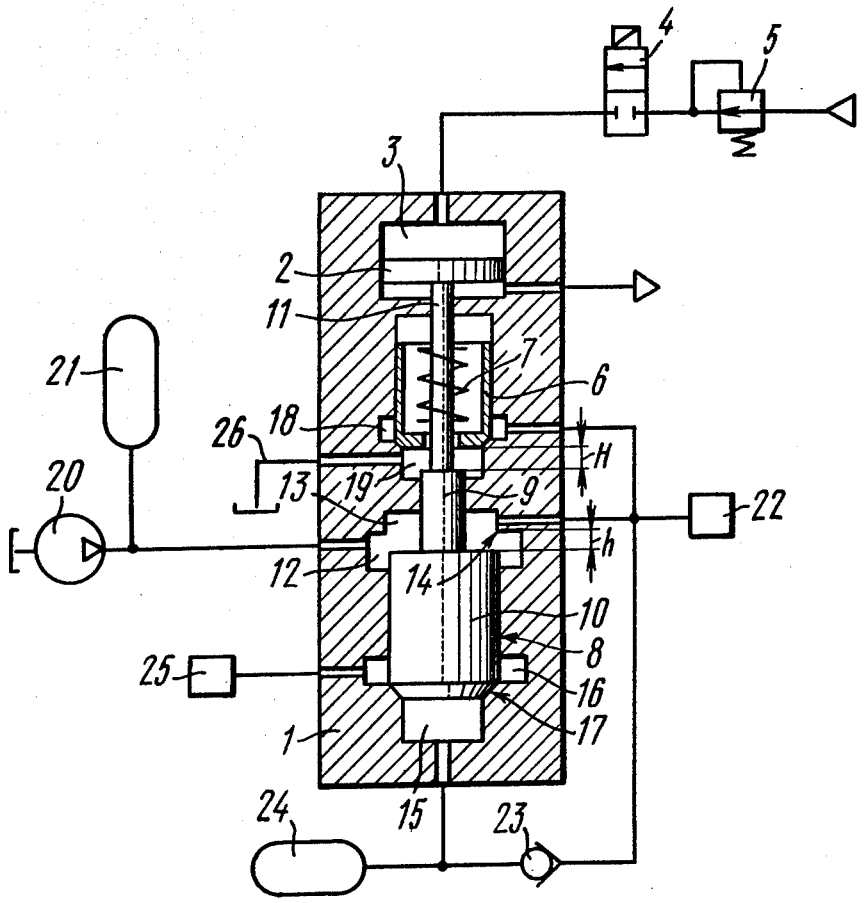
4
5
3
2
11
7
6
21
26
18
H
20
13
19
9
22
h
12
14
10
8
25
16
17
1
24
15
23

PULSATOR FOR HYDRAULIC SYSTEMS CONTROLLING ACTUATING MECHANISMS

FIELD OF THE INVENTION

The invention is concerned with metal working by pressure and specifically with pulsators for hydraulic systems controlling actuating mechanisms. The pulsator is of particular advantage in the case of hydraulic presses with pulsating load, designed for sizing solid and hollow elongate products, such as profiles and tubes of different section, made of high-tensile steel, titanium and other alloys.

BACKGROUND OF THE INVENTION

Pulsators of electromagnetic, mechanical, pneumatic, hydraulic and combined types are used nowadays to obtain pulsating loads in actuating mechanims. However, the most promising of all are hydraulic pulsators which can be used in manufacturing powerful equipment with pulsating loads.

The basic problem in the development of such equipment is the attainment of a great force in the actuating mechanisms, high frequency of load alternations, and efficiency. To this end, the pulsators must be of great capacity, quick-acting, leak-proof, capable of operating on water or aqueous emulsions and easily controlled.

The known basic types such as spool, valve, and plunger pulsators have not been widely employed in industry because of complicated circuits, poor reliability and short service life, difficulty in obtaining the required force and frequencies, low efficiency and incomplete unloading of the actuating member. The most up to date is the pulsator for hydraulic systems controlling actuating mechanisms, disclosed in U.S. Pat. No. 3,851,667 British Pat. No. 1,377,892.

The prior art pulsator comprises a housing accommodated coaxially in the cylindrical borings of which are a pusher, a delivery valve and a pneumatic piston displacing in the cavity communicating with the pneumatic control system. The housing has an upper cavity formed by the pusher piston, communicating with the high-pressure main and a lower cavity formed by the pusher piston, communicating with the actuating mechanism via a non-return valve.

As the fluid pressure in the system builds up, the specific pressure on the delivery valve chamfer of the prior art pulsator decreases since the pneumatic cylinder piston presses the delivery valve onto the chamfer with a constant force while the force under the pusher increases as the fluid pressure in the system becomes higher. When the force acting upon the pusher reaches about 50% of that developed by the pneumatic cylinder piston, the tight connection between the delivery valve chamfer and the seat becomes loose thus causing leaks of the working fluid which increase as result of a pressure built-up in the system. The working fluid leaks result in the increase of time required for producing pressure in the system and this prolongs the time of the technological cycle, reduces the efficiency of the press, leads to wear of the delivery valve and the valve seat.

In addition, when returning the fluid from the actuating mechanism the drive pumps also communicate with the return main which results in the reduction of the hydraulic system efficiency and the increase of the pulsator overall size because of the necessity to enlarge clear openings. With the control valve being open prior to the initiation of the actuating mechanism operation, an additional device should be provided to make the pusher piston lower cavity leak-proof as is the case with the control system disclosed in USSR Inventor's Certificate No. 506,514.

SUMMARY OF THE INVENTION

It is an object of the present invention to provide a pulsator wherein due to ensuring leak-tightness of the high-pressure main and a novel system of communication among the elements makes it possible to increase the efficiency of the hydraulic system, to simplify the actuating mechanism control system, and to increase the reliability.

The present invention essentially consists in providing a pulsator for hydraulic systems controlling actuating mechanisms, comprising accommodated coaxially one above another in the cylindrical boring of a housing: a pusher made in the form of a piston with a rod, a delivery valve and a pneumatic piston displacing in a cavity connected to a pneumatic control system, there being provided above the pusher piston an upper cavity connected to a high-pressure main and below the pusher piston a lower cavity connected to the actuating mechanism via a non-return valve, wherein in accordance with the invention a stem is provided, one end of which is mechanically coupled with the pneumatic piston while the other, with the pusher rod butt end, the said stem passing through a port made in the delivery valve. The delivery valve is mounted so that a clearance is left between it and the pusher rod. Formed above the pusher piston is an auxiliary cavity which being an extension of the upper cavity bordering on the pusher piston, is defined by a leading edge adapted to separate said cavities when it touches the piston at the moment of the pusher upward movement for opening the delivery valve, the auxiliary cavity being in communication with the actuating mechanism. There is provided coaxially above the lower cavity of the pusher piston an annular cavity separated from the lower cavity of the piston by a leading edge interacting with the pusher piston and communicating with a valve controlling resetting of the pusher.

Most advantageously the pulsator of the present invention ensures complete leak-tightness throughout the entire period of the operation cycle, provides separation of the high-pressure main from the return main during fluid discharge from the actuating mechanism (for accumulating energy from the pumps), and employs a relatively simple system controlling resetting of the pusher.

BRIEF DESCRIPTION OF THE DRAWINGS

The invention will now be described in greater detail with reference to a specific embodiment thereof, taken in conjunction with the accompanying drawing wherein a pulsator is shown diagrammatically.

DETAILED DESCRIPTION OF THE INVENTION

A pulsator for hydraulic systems controlling actuating mechanisms comprises a housing 1 in whose cylindrical borings are disposed a pneumatic piston 2 displacing in a cavity 3 connected to a pneumatic control system comprising a distributing valve 4 and a pressure regulator 5. The pulsator includes a delivery valve 6 with a spring 7 and a pusher 8 comprising a rod 9 and a piston 10. A stem 11 is disposed between the rod 9 and the piston 2.

Above the piston 10 of the pusher 8 are disposed a cavity 12, an auxiliary cavity 13 defined by a leading edge 14 used to separate the cavities 12 and 13 when it touches the piston 10 at the moment of the upward movement of the pusher 8 for opening the delivery valve 6.

Below the piston 10 of the pusher 8 are disposed a lower cavity 15, and an annular cavity 16 separated from the cavity 15 by a leading edge 17.

Also provided are an annular cavity 18 of the delivery valve 6 and a cavity 19 disposed below the delivery valve 6. The cavity 12 is in communication with a high-pressure main comprising a pump 20 and a bottle 21; the cavity 13 is connected to an actuating mechanism 22, to the cavity 18 and via a non-return valve 23 to the cavity 15 connected to a bottle 24; the cavity 16 is connected to a valve 25 controlling resetting of the pusher 8; the cavity 19 is connected to a return main 26.

The pulsator operates in the following way.

Under the action of the air pressure in the cavity 3 the pneumatic piston 2 retains the pusher 8 in its extreme lower position, the spring 7 presses the delivery valve 6 onto the seat. When the pump 20 is started, the fluid via the cavities 12 and 13 of the pulsator housing 1 flows to the actuating mechanism 22, to the cavity 18 of the delivery valve 6 and via the non-return valve 23 to the cavity 15. The fluid pressure in the system rises, the actuating mechanism 22 runs working. When the fluid pressure in the system reaches a value corresponding to the preset air pressure in the cavity 3, the pusher 8 overcoming the force of the pneumatic piston 2, transmitted through the stem 11, under the action of the force directed from the side of the cavity 15 starts moving upward. As soon as the pusher covers the distance equalling h, the piston 10 will touch the leading edge 14 and the cavities 12 and 13 will separate. The fluid from the pump 20 will flow to the bottle 21 accumulating energy therein. On covering upwardly a distance H, the rod 9 will touch the delivery valve 6 and, overcoming the force of the spring 7, will open it. When the pusher 8 moves upward, the cavities 15 and 16 communicate with each other, with tightness therein being ensured by the control valve 25. The delivery valve 6 is held open due to fluid pressure differential between the cavities 13 and 15 which is dependent upon the capacity of the bottle 24.

At that moment the fluid from the actuating mechanism 22 will flow to the return main 26 via the delivery valve 6. The actuating mechanism 22 runs idle. At the end of idling the control valve 25 interconnected with said mechanism (the interconnection is not shown in the drawing) initiates a signal for discharging the fluid from the cavities 15 and 16 to ensure resetting of the pusher 8.

While moving downwardly the rod 9 allows the delivery valve 6 to lower onto the seat under the action of the spring 7, thereby separating the cavities 18 and 19. When the piston 10 moves off the area of the leading edge 14, the cavities 12 and 13 communicates with each other. When the pusher 8 resets onto the seat, the cavities 15 and 16 are separated by the leading edge 17, which ensures tightness of the cavity 15 and the bottle 24.

From the pump 20 the fluid flows to the actuating mechanism 22 again and the cycle recurs. The force at the piston 2 and, correspondingly, the fluid pressure in the hydraulic system are controlled by changing the air pressure in the cavity 3 by means of the pressure regulator 5 and the distributing valve 4.

Reliable tightness of the high-pressure main during the working run is ensured due to the fact that specific pressure at the chamfer of the delivery valve 6 does not depend upon the change of fluid pressure in the system. When the fluid is being discharged from the actuating mechanism 22, the drive pump 20 is shut off from the return main 26, which results in accumulation of energy in the bottle 21.

The pulsator of such a design is a quick-acting device (pick-up time is not more than 0.03 s.), featuring capacity from 1000 to 5000 l/min, adequate tightness throughout the entire working cycle which makes it possible to use it for controlling high-capacity distributors and to manufacture, for example, presses with pulsating loads of 1000 tf and higher and frequency of load alternations from 10 to 20 Hz., and an increased efficiency of the hydraulic system.

What is claimed is:

1. A pulsator for hydraulic systems controlling actuating mechanisms, connected via a non-return valve to an actuating mechanism, communicating with a pneumatic control system, with a high-pressure main, with a valve controlling resetting of a pusher, comprising a housing provided with cylindrical borings, the cylindrical borings of said housing accommodating coaxially disposed therein: a pusher made in the form of a piston with a rod; a delivery valve mounted with a clearance in respect to said rod of said pusher; a pneumatic piston; a cavity connected to a pneumatic control system; said pneumatic piston displacing in said cavity; an upper cavity of the pusher piston, disposed above said piston of said pusher and communicating with the high-pressure main; a lower cavity of the pusher piston, disposed under said piston of said pusher and communicating via a non-return valve with said actuating mechanism; a stem mechanically connected by its opposite ends respectively to said pneumatic piston and to the butt end of said rod of said pusher; said stem passing through a port made in said delivery valve; an auxiliary cavity connected to said actuating mechanism, being an extension of said upper cavity and defined by a leading edge serving for separating said cavities when it touches said piston of said pusher at the moment of its upwardly movement for opening said delivery valve; an annular cavity disposed coaxially above said lower cavity, separated from said lower cavity of said piston by a leading edge interacting with said pusher piston, and connected to the valve controlling resetting of said pusher.

* * * * *